United States Patent [19]

Henke et al.

[11] 4,034,799

[45] July 12, 1977

[54] MECHANISM FOR ADJUSTING A GUIDE ROLL-RACK

[75] Inventors: Theodore T. Henke, Winfield Township, Butler County; George J. Wagner, Jr., North Fayette Township, Allegheny County, both of Pa.

[73] Assignee: United States Steel Corporation, Pittsburgh, Pa.

[21] Appl. No.: 627,402

[22] Filed: Oct. 30, 1975

[51] Int. Cl.[2] ..... B22D 11/06; B65G 13/00

[52] U.S. Cl. ..... 164/282; 164/283 S; 193/35 R

[58] Field of Search ..... 164/89, 273 R, 282, 164/283 R, 283 S; 193/35 R

[56] References Cited

U.S. PATENT DOCUMENTS

| | | | |
|---|---|---|---|
| 3,438,425 | 4/1969 | Butkevich | 164/282 X |
| 3,550,675 | 12/1970 | Hess | 164/282 |
| 3,662,813 | 5/1972 | Stull | 164/273 R |
| 3,727,673 | 4/1973 | Gallucci | 164/282 |
| 3,900,066 | 8/1975 | Schoffmann | 164/282 |
| 3,923,093 | 12/1975 | La Tour | 164/282 |

FOREIGN PATENT DOCUMENTS

| | | | |
|---|---|---|---|
| 680,036 | 2/1964 | Canada | 164/282 |

*Primary Examiner*—Francis S. Husar
*Assistant Examiner*—John S. Brown
*Attorney, Agent, or Firm*—Walter P. Wood

[57] ABSTRACT

A mechanism for adjusting the edge rolls of a guide roll rack of a continuous casting machine to accommodate castings of different width. The edge rolls are journaled in bearing brackets mounted on the frame of the roll-rack for movement in and out. Each bearing bracket is connected to a respective screw jack. Shafts and gearing mounted on the outside of the frame operate the screw jacks.

4 Claims, 4 Drawing Figures

MECHANISM FOR ADJUSTING A GUIDE ROLL-RACK

This invention relates to an improved mechanism for adjusting a guide roll-rack of a continuous-casting machine to accomodate castings of different widths.

Conventional practice in the continuous casting of metals is to pour liquid metal continuously through an openended, vertically oscillating, water-cooled mold. A casting, which at this stage has only a thin solidified skin and a liquid core, emerges from the bottom of the mold and travels through a guide roll-rack where it is subjected to intense water sprays to promote its solidification. The rolls of the guide roll-rack closely confine the casting at all four faces and prevent its skin from bulging.

In forming castings which have one broader dimension and one narrower dimension when viewed in cross section (for example steel slabs), it is known to use an adjustable mold to enable the broad cross-sectional dimension or width of the casting to be varied. Reference can be made to Colombo U.S. Pat. No. 3,292,216 for a showing of a typical adjustable mold. For each adjustment in the mold to vary the width of the casting, it is necessary to make a corresponding adjustment in the guide roll-rack; that is, the spacing between the edge rolls which contact the narrown faces of the casting must be adjusted correspond with the width of the casting. Reference can be made to Lemper U.S. Pat. No. 3,268,956 for an earlier showing of a guide roll-rack equipped with a mechanism for effecting such adjustment.

An object of the present invention is to provide, in a guide roll-rack, an improved and simplified mechanism for adjusting the position of the edge rolls, contrasted with previous mechanisms used for this purpose.

A further object is to provide a mechanism of the foregoing type in which the components are mounted in a way that avoids damage from warpage of the frame of the guide roll-rack and from spillage of liquid metal.

A further object is to provide a mechanism of the foregoing type which permits the edge rolls of the rack to be aligned and adjusted in unison with a single drive.

Figure 1:
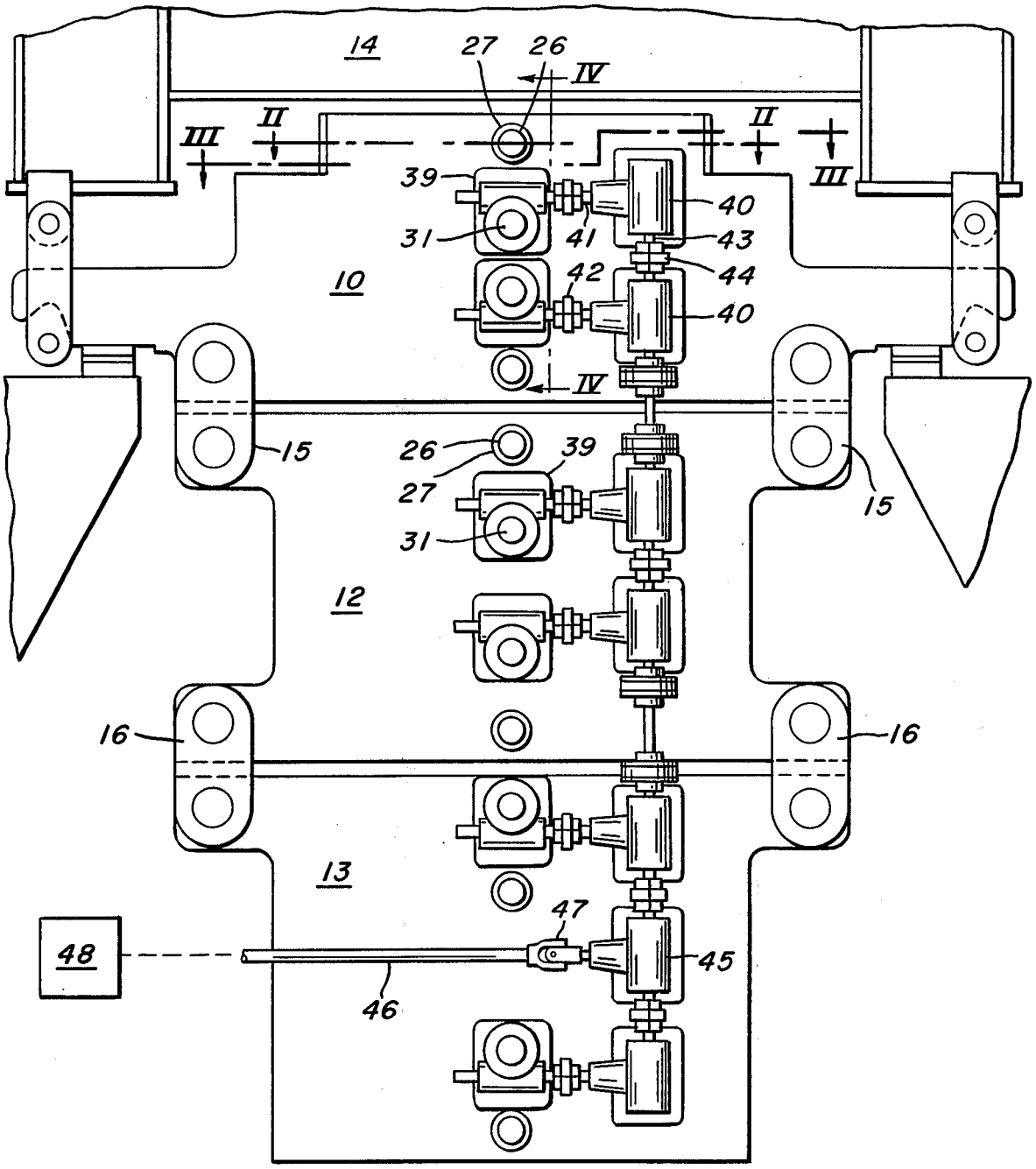
FIG. 1 is a side elevational view of a guide roll-rack equipped with our improved adjusting mechanism.
Figure 2:
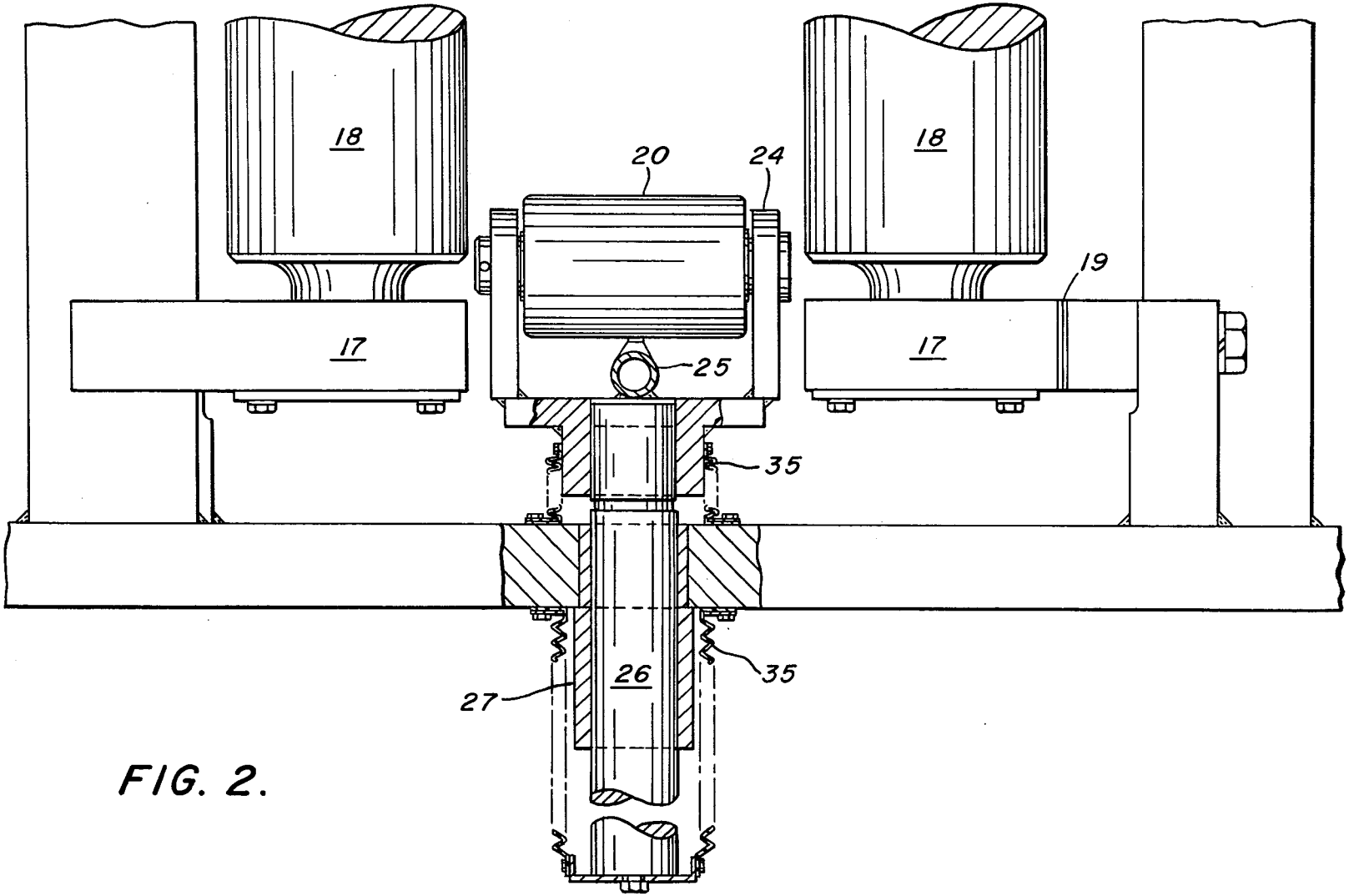
FIG.2 is a fragmentary horizontal section on line II-II of FIG. 1 omitting the drive for the adjusting means for clarity.
Figure 3:
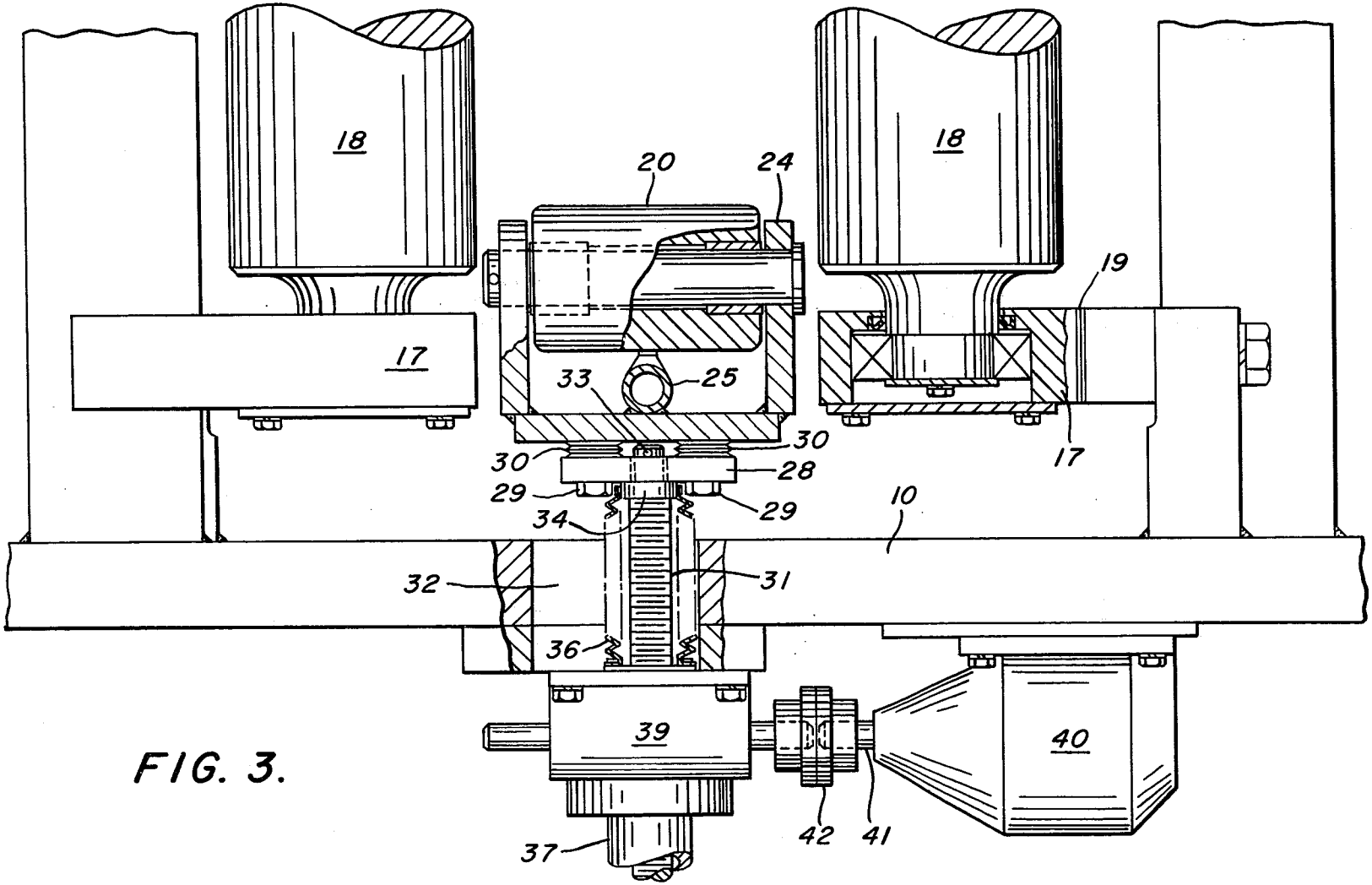
FIG. 3 is a fragmentary horizontal section on line III-III of FIG. 1.
Figure 4:
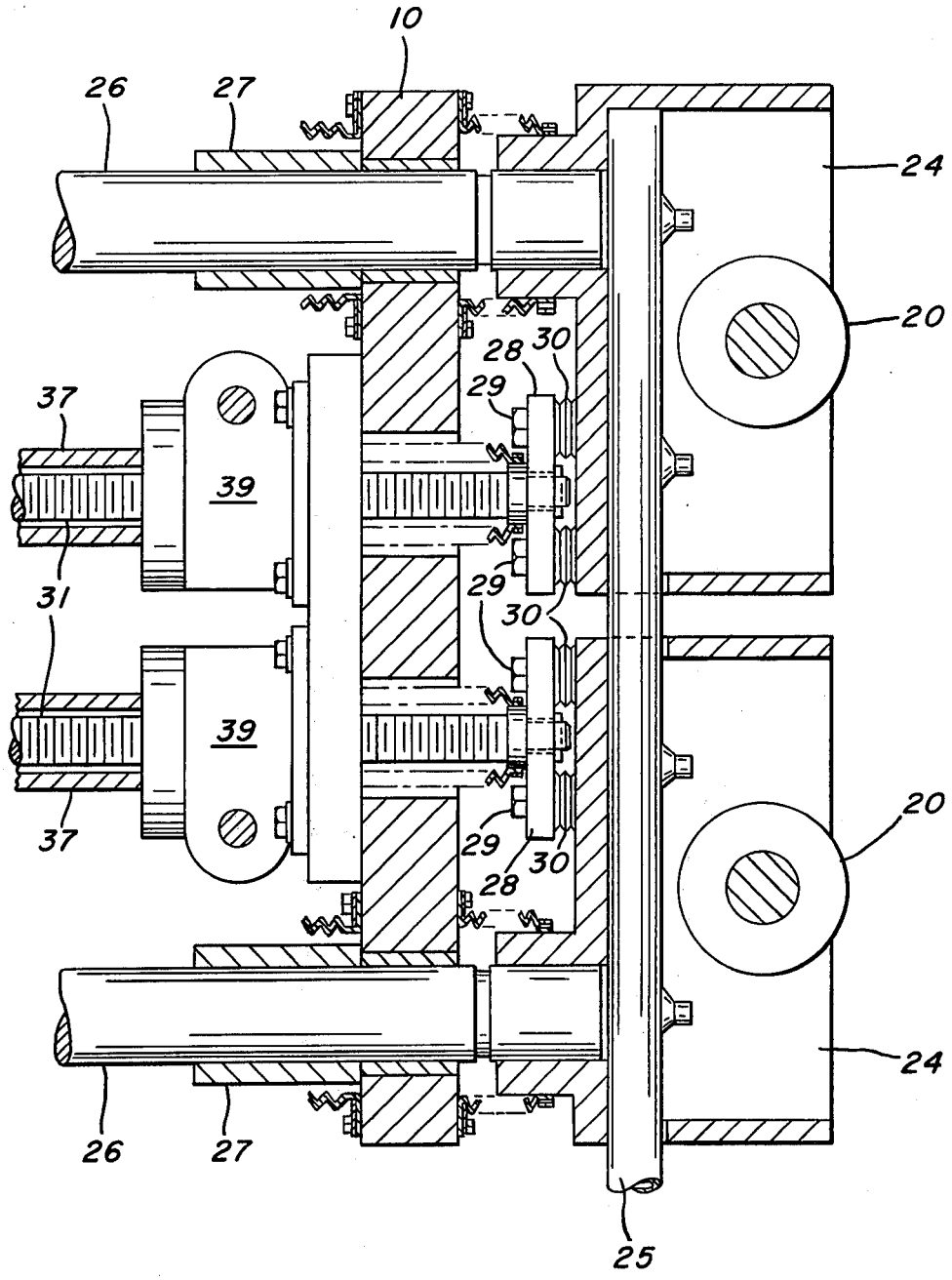
FIG. 4 is a vertical section on line IV-IV of FIG. 1.

The drawings show a typical guide roll-rack to which our adjusting mechanism may be applied. As shown in FIG. 1, the rack includes three frame sections 10, 12 and 13. The uppermost section 10 is suspended beneath a mold support frame 14. The middle section 12 is suspended from the uppermost section 10 on links 15, and the lower section is suspended from the middle section on links 16, whereby the section can flex to a limited extent with respect to one another. As shown in FIGS. 2,3 and 4 bearing chocks 17 are mounted within the frame sections, and rolls 18 are journaled in these chocks for contacting the broad faces of a casting. Shims 19 are inserted under the chocks to enable rolls 18 to be positioned accurately. Edge rolls 20, adjustably supported in accordance with our invention as hereinafter described in more detail, also are mounted within the frame sections. The roll-rack illustrated, apart from the mounting of the edge rolls, may be of known construction. Our adjusting mechanism of course is not limited to use with a roll-rack of the particular construction illustrated.

In accordance with our invention, we journal each edge roll 20 in a respective bearing bracket 24 which also carries a spray header 25 for supplying cooling water to the narrow face of a casting. As shown in FIGS. 2 and 4, a guide pin 26, preferably of stainless steel, is fixed to the outer face of the bearing bracket and slidably projects through a guide sleeve 27 fixed to the wall of frame section. As shown in FIGS. 3 and 4, we attach a plate 28 to the outer face of the bearing bracket 24 with bolts 29 and interpose springs 30 encircling the bolts between the bearing bracket and plate. A screw jack 31 is connected to plate 28 and extends through a hole 32 in the wall of the frame section. The springs 30 protect the screw jack against overtravel and possible pulling of breakout material down through the casting machine as could also damage the screw jack. A transverse pin 33 and a collar 34 hold the screw jack in place on plate 28. Preferably we cover the guide pin 26 and screw jack 31 with flexible boots 35 and 36 respectively to protect them against foreign material. The protruding end of the screw jack has a protective cover 37.

As shown in FIGS. 1 and 4, we mount respective worm gear boxes 39 on the outside of the walls of the frame sections 10, 12 and 13 to operate each of the screw jacks 31. We mount respective mitre gear boxes 40 alongside each worm gear box 39. The mitre gears are connected to the worms through respective horizontal shafts 41 and couplings 42. The mitre gear boxes 40 are connected to one another through a series of vertical shafts 43 and couplings 44. We connect another mitre box 45 between two of the mitre gear boxes 40. a drive shaft 45 between two of the mitre gear boxes 40. We connect a drive shaft 46 to the mitre gear box 45 through a universal joint 47. The drive shaft 46 leads to a drive 48 at a remote location.

In operation, whenever we adjust the mold above the guide roll rack to change the width of casting formed therein, we operate the drive 48 to effect a corresponding adjustment in the position of the edge rolls 20. The motion is transmitted to the bearing brackets 24 at either side of the roll-rack via the various shafts, gears and couplings to move all the edge rolls 20 and spray header 25 at that side in or out as needed to match the casting width.

From the foregoing description, it is seen that our invention affords a simple mechanism which enables the position of all edge rolls at either side of a guide roll-rack to be adjusted in unison to correspond with adjustments made in a mold. The drive is located remote from the roll-rack, which usually is housed in a spray chamber, and hence is not subject to damage from the sprays.

We claim:

1. In a guide roll rack for confining a continuously formed casting which has broader and narrower faces, said rack including a frame, a plurality of rolls for contacting the broad faces of the casting, bearing means in said frame in which said rolls are journaled, a plurality of edge rolls for contacting the narrow faces of the casting, and bearing means in said frame in which edge rolls are journaled, the combination therewith of an improved mechanism for adjusting the position of said edge rolls and their bearing means to accommodate castings having different broad face dimensions, said mechanism comprising respective guide pins carried by the bearing means for said edge rolls, guide sleeves carried by said frame slidably receiving said pins, said pins supporting the bearing means for said edge rolls for movement in and out with respect to said frame, screw jacks connected to the bearing means for said edge rolls and extending through said frame, shafts and gearing mounted on the outside of said frame said screw jacks for moving said edge rolls and their bearing means in unison, and drive means remotely located connected to said shafts and gearing.

2. A combination as defined in claim 1 in which said shafts and gearing include respective worm gear boxes mounted on the outside of said frame each of said screw jacks, respective mitre gear boxes mounted on said frame alongside each of said worm gear boxes, horizontal shafts connecting said mitre gear boxes and said worm gear boxes, and vertical shafts connecting said mitre gear boxes with one another.

3. A combination as defined in claim 1 further comprising a spray header mounted on the bearing means for said edge rolls for supplying cooling water to the narrow face of a casting.

4. In a guide roll-rack for confining a continuously formed casting which has broader and narrower faces, said rack including a frame, a plurality of rolls for contacting the broad faces of the casting, bearing means in said frame in which said rolls are journaled, a plurality of edge rolls for contacting the narrow faces of the casting, and bearing means in said frame in which said edge rolls are journaled, the combination therewith of an improved mechanism for adjusting the position of said edge rolls and their bearing means to accommodate castings having different broad-face dimensions, said mechanism comprising guide means in said frame supporting the bearing means for said edge rolls for movement in and out with respect to said frame, screw jacks connected to the bearing means for said rolls and extending through said frame, spring means in the bearing means for said edge rolls to protect said screw jacks, shafts and gearing mounted on the outside of said frame connected to said screw jacks for moving said edge rolls and their bearing means in unison, and drive means remotely located connected to said shafts and gearing.

* * * * *

UNITED STATES PATENT OFFICE

CERTIFICATE OF CORRECTION

Patent No. 4,034,799 Dated July 12, 1977

Inventor(s) Theodore T. Henke and George J. Wagner, Jr.

It is certified that error appears in the above-identified patent and that said Letters Patent are hereby corrected as shown below:

Column 1, line 28, "narrown" should read --narrow--;
(in application, page 2, line 4).
line 29, after "adjusted" insert --to--;
(in application, page 2, line 4).
line 61, "section" should read --sections--;
(in application, page 3, line 4).

Column 2, line 38, after "mitre" insert --gear--;
(in application, page 4, line 13).
lines 39 and 40, the following words were inserted erroneously, "a drive shaft 45 between two of the mitre gear boxes 40".

Claim 1, line 11, after "frame" insert --connected to--;
(in amendment dated December 20, 1976).

UNITED STATES PATENT OFFICE

CERTIFICATE OF CORRECTION

Patent No. 4,034,799 Dated July 12, 1977

Inventor(s) Theodore T. Henke and George J. Wagner, Jr.

It is certified that error appears in the above-identified patent and that said Letters Patent are hereby corrected as shown below:

Claim 4, line 17, after "said" insert --edge--;
(in amendment dated December 20, 1976).

Signed and Sealed this

*Tenth* Day of *January 1978*

[SEAL]

*Attest:*

RUTH C. MASON
*Attesting Officer*

LUTRELLE F. PARKER
*Acting Commissioner of Patents and Trademarks*